US009071893B2

(12) United States Patent
Kim et al.

(10) Patent No.: US 9,071,893 B2
(45) Date of Patent: Jun. 30, 2015

(54) MULTI-ARRAY ULTRASONIC PROBE APPARATUS AND METHOD FOR MANUFACTURING MULTI-ARRAY PROBE APPARATUS

(71) Applicant: SAMSUNG ELECTRONICS CO., LTD., Suwon-si (KR)

(72) Inventors: Young-Il Kim, Suwon-si (KR); Dong Wook Kim, Seoul (KR); Bae Hyung Kim, Seoul (KR); Jong Keun Song, Yongin-si (KR); Seung Heun Lee, Seoul (KR); Kyung Il Cho, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 151 days.

(21) Appl. No.: 13/741,907

(22) Filed: Jan. 15, 2013

(65) Prior Publication Data

US 2013/0242705 A1 Sep. 19, 2013

(30) Foreign Application Priority Data

Mar. 14, 2012 (KR) ..... 10-2012-0026098

(51) Int. Cl.

| | |
|---|---|
| ***H04R 1/00*** | (2006.01) |
| ***G10K 11/00*** | (2006.01) |
| ***H04R 31/00*** | (2006.01) |
| ***B06B 1/02*** | (2006.01) |

(52) U.S. Cl.

CPC ..... *H04R 1/00* (2013.01); *Y10T 29/49005* (2015.01); *G10K 11/004* (2013.01); *H04R 31/00* (2013.01); *B06B 1/0292* (2013.01)

(58) Field of Classification Search

CPC ..... H04R 1/00; H04R 31/00; G10K 11/004; Y10T 29/49005; B06B 1/0292

See application file for complete search history.

(56) References Cited

U.S. PATENT DOCUMENTS

| | | | | |
|---|---|---|---|---|
| 5,125,153 | A * | 6/1992 | Frey et al. | 29/840 |
| 5,655,276 | A | 8/1997 | Pattanayak et al. | |
| 6,104,126 | A | 8/2000 | Gilmore | |
| 7,393,773 | B2 | 7/2008 | Malantonio et al. | |
| 2005/0169107 | A1 | 8/2005 | Thomenius et al. | |

(Continued)

FOREIGN PATENT DOCUMENTS

| | | |
|---|---|---|
| EP | 2610860 A2 | 7/2013 |
| GB | 2430259 A | 3/2007 |

(Continued)

OTHER PUBLICATIONS

Communication dated Aug. 26, 2013 issued by the Korean Intellectual Property Office in counterpart Korean Application No. 1020120026098.

(Continued)

*Primary Examiner* — Luke Ratcliffe
*Assistant Examiner* — Hovhannes Baghdasaryan
(74) *Attorney, Agent, or Firm* — Sughrue Mion, PLLC

(57) ABSTRACT

A multi-array type ultrasonic probe apparatus includes n tiles which transmit and receive an ultrasonic beam; and a substrate having n guide portions on which the n tiles are mounted, respectively, to be aligned in a multi-array. The multi-array ultrasonic probe apparatus may align tiles in identical directions and at identical levels to control a direction and a time for transmitting and receiving an ultrasonic beam to be transmitted and received at the tiles, thereby providing a stable ultrasonic beam.

19 Claims, 7 Drawing Sheets

(56) References Cited

U.S. PATENT DOCUMENTS

| | | | | |
|---|---|---|---|---|
| 2006/0040417 | A1 | 2/2006 | Eldridge et al. | |
| 2010/0013358 | A1 | 1/2010 | Nakayama | |
| 2010/0241004 | A1 | 9/2010 | Jung et al. | |
| 2010/0255623 | A1* | 10/2010 | Huang | 438/51 |
| 2011/0071397 | A1 | 3/2011 | Wodnicki et al. | |
| 2012/0029393 | A1* | 2/2012 | Lee | 601/2 |
| 2012/0118475 | A1 | 5/2012 | Baumgartner | |

FOREIGN PATENT DOCUMENTS

| | | | |
|---|---|---|---|
| JP | 05-212035 | A | 8/1993 |
| JP | 07-236638 | A | 9/1995 |
| JP | 2002-058098 | A | 2/2002 |
| JP | 2005-87577 | A | 4/2005 |
| JP | 2008-518553 | A | 5/2008 |
| JP | 2010-22931 | A | 2/2010 |
| JP | 2012-015851 | A | 1/2012 |
| KR | 100684677 | B1 | 2/2007 |
| KR | 1020080081991 | A | 9/2008 |
| KR | 100967024 | B1 | 6/2010 |
| KR | 100996150 | B1 | 11/2010 |
| KR | 1020130078935 | A | 7/2013 |

OTHER PUBLICATIONS

Communication dated Jan. 27, 2014 issued by the European Patent Office in counterpart European Patent Application No. 13159231.3.

Communication dated Jul. 15, 2014 from the State Intellectual Property Office of P.R. China in a counterpart application No. 201310077389.5.

Communication dated Apr. 8, 2014 issued by the Japanese Patent Office in counterpart Japanese Patent Application No. 2013-049912.

* cited by examiner

MULTI-ARRAY ULTRASONIC PROBE APPARATUS AND METHOD FOR MANUFACTURING MULTI-ARRAY PROBE APPARATUS

CROSS-REFERENCE TO RELATED APPLICATION

This application claims priority from the Korean Patent Application No. 10-2012-0026098, filed on Mar. 14, 2012, in the Korean Intellectual Property Office, the entire disclosure of which is incorporated herein by reference in its entirety.

BACKGROUND

1. Field

Apparatuses and methods consistent with exemplary embodiments relate to a multi-array ultrasonic probe apparatus that may provide a stable ultrasonic beam by aligning tiles in identical directions and at identical levels.

2. Description of Related Art

A diagnostic ultrasound system is an apparatus that may radiate, from a body surface of a target object, an ultrasonic beam toward a desired part inside a body, and may obtain a cross section of soft tissues or an image of a blood flow, using a reflected ultrasonic beam.

The diagnostic ultrasound system may include an ultrasonic probe apparatus that may obtain ultrasonic data by transmitting an ultrasonic beam to the target object and receiving an ultrasonic beam reflected from the target object.

Here, the ultrasonic probe apparatus may obtain ultrasonic data about the target object by transmitting and receiving an ultrasonic beam while moving along with the target object in contact with the ultrasonic probe apparatus.

SUMMARY

According to an aspect of an exemplary embodiment, there is provided a multi-array ultrasonic probe apparatus, including n tiles formed to transmit and receive an ultrasonic beam, with respect to a target object, and a substrate including n guide portions on which the n tiles are mounted, respectively, to be aligned in a form of a multi-array. Here, n denotes a natural number.

The substrate may further include n adhesive portions below the n guide portions, the n adhesive portions on which an adhesive material that bonds the n tiles to the substrate may be disposed.

The substrate may further include n outlets formed to take out the excess adhesive, to an outside, the adhesive material disposed on the n adhesive portions that the n tiles may be in contact with when the n tiles are mounted on the n guide portions.

Widths of the n guide portions may be wider than widths of the n adhesive portions.

The n guide portions each may have identical heights, and the n adhesive portions each may have identical heights.

The n guide portions may be disposed in a form of a matrix on the substrate such that a predetermined gap separates the n guide portions, and the n adhesive portions may be disposed in a form of a matrix on the substrate such that a predetermined gap separates the n adhesive portions.

Widths of the n guide portions may be wider than widths of the n tiles by a predetermined size.

Each of the n tiles may include an Application Specific Integrated Circuit (ASIC), and a Capacitive Micromachined Ultrasonic Transducer (CMUT) attached to an upper portion of the ASIC.

The substrate may be formed of one of silicon, glass, and a polymer-based material.

According to another general aspect of an exemplary embodiment, there is provided a method of manufacturing a multi-array ultrasonic probe apparatus, the method including providing a substrate including n guide portions, and aligning n tiles formed to transmit and receive an ultrasonic beam in a form of a multi-array by mounting the n tiles on the n guide portions, respectively. Here, n denotes a natural number.

According to one or more of exemplary embodiments, a multi-array ultrasonic probe apparatus may obtain more accurate ultrasonic data by mounting tiles to be aligned in identical directions and at identical levels on a substrate, thereby controlling a direction and a time for transmitting and receiving an ultrasonic beam to be transmitted and received at the tiles.

According to one or more of exemplary embodiments, a multi-array ultrasonic probe apparatus may readily align tiles in a form of a multi-array, using a substrate including guide portions, in which tiles are to be mounted, disposed in a form of a matrix such that a predetermined gap separates the guide portions.

According to one or more of exemplary embodiments, a multi-array ultrasonic probe apparatus may reduce a margin of error of guide portions and adhesive portions to be within a few micrometers (μm), using a substrate on which the guide portions and the adhesive portions are formed by semiconductor process technology, thereby uniformly aligning tiles that are to be mounted on the guide portions and to be in contact with the adhesive portions.

According to one or more of exemplary embodiments, a multi-array ultrasonic probe apparatus may be manufactured at a relatively low cost or in a relatively short period of time, using a substrate formed of a polymer-based material by imprinting technology based on a preformed substrate, for example, a silicon substrate.

According to one or more of exemplary embodiments, a multi-array ultrasonic probe apparatus may include an outlet on one side of each adhesive portion on a substrate, and may provide a path for discharging an adhesive material to an outside when the adhesive material, disposed in the adhesive portion that a tile may be in contact with, is pressed by the tile to be mounted on a guide portion, thereby preventing damage to the tiles.

BRIEF DESCRIPTION OF THE DRAWINGS

The above and/or other aspects will become more apparent by describing certain exemplary embodiments, with reference to the accompanying drawings, in which.

Figure 1A:
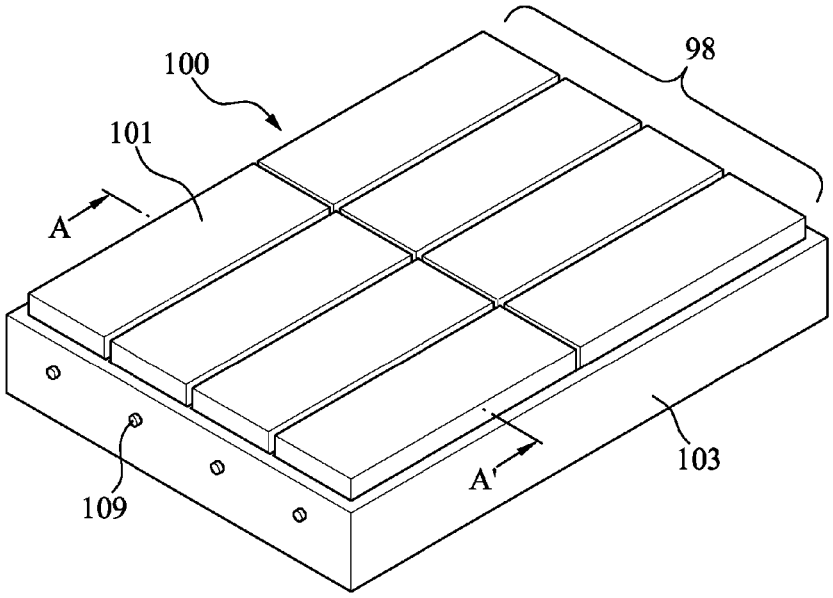
FIG. 1A is a perspective view illustrating an example of a multi-array ultrasonic probe apparatus according to an exemplary embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Hereinafter, certain exemplary embodiments are described in detail below with reference to the accompanying drawings.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, description of well-known functions and constructions may be omitted for increased clarity and conciseness.

Figure 1B:
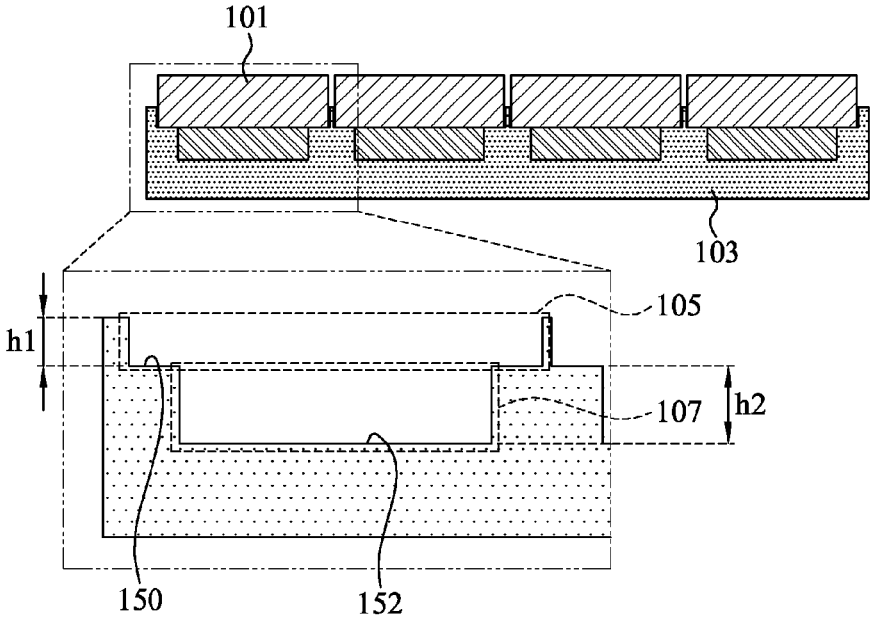
FIG. 1B is a cross-sectional view cut along a line A-A' of FIG. 1A.

FIGS. 1A and 1B illustrate an example of a structure of a multi-array ultrasonic probe apparatus 100. In particular, FIG. 1A is a perspective view of the multi-array ultrasonic probe apparatus 100, and FIG. 1B is a cross-sectional view cut along a line A-A' of FIG. 1A.

Referring to FIGS. 1A and 1B, the multi-array ultrasonic probe apparatus 100 includes a tile 101, and a substrate 103.

For instance, n tiles 98 may be provided. Here, n denotes a natural number. Although FIG. 1A illustrates only eight tiles, any appropriate number of tiles, fewer or greater than eight, may be provided.

The tile 101 may obtain ultrasonic data by transmitting and receiving an ultrasonic beam with respect to a target object. The tile 101 may include an Application Specific Integrated Circuit (ASIC), and a Capacitive Micromachined Ultrasonic Transducer (CMUT) attached on an upper portion of the ASIC.

The substrate 103 includes n guide portions 105 and n adhesive portions 107 which correspond to n tiles 98 and are provided in a form of a matrix. The n tiles 98 may be mounted on the n guide portions 105 and may be aligned in a form of a multi-array, which may include a multiple number of one-dimensional arrays. That is, the n guide portions 105 may be attached in rows and columns on the substrate 103 such that a predetermined gap separates the n guide portions 105. Also, the n adhesive portions 107 may be arranged in rows and columns on the substrate 103 such that a predetermined gap separates the n adhesive portions 107. Accordingly, the n tiles 98 may be aligned in uniform directions, by disposing the n tiles 98 to be mounted on the n guide portions 105 collinearly, for example, in an x-axial direction or a y-axial direction.

In particular, the n guide portions 105 may be provided on an upper surface 150 of the substrate 103 so that the n tiles 98 may be mounted on the n guide portions 105, respectively. Further, the n adhesive portions 107 may be provided on a lower surface 152 of the substrate 103 at positions corresponding to the positions of the n guide portions 105, respectively. An adhesive material, for example epoxy, may be disposed in the adhesive portions 107 to bond the n tiles 98 to the substrate 103.

Also, the substrate 103 may include an outlet 109 on one side of one or more of the adhesive portions 107. Accordingly, when the adhesive material, disposed in the respective adhesive portion 107 is pressed by the tile 101 to be mounted in the respective guide portion 105, the adhesive material may be prevented from leaking in a direction of the tile 101 by discharging the adhesive material to an outside through the respective outlet 109, thereby preventing damage to the tile 101.

Figure 2:
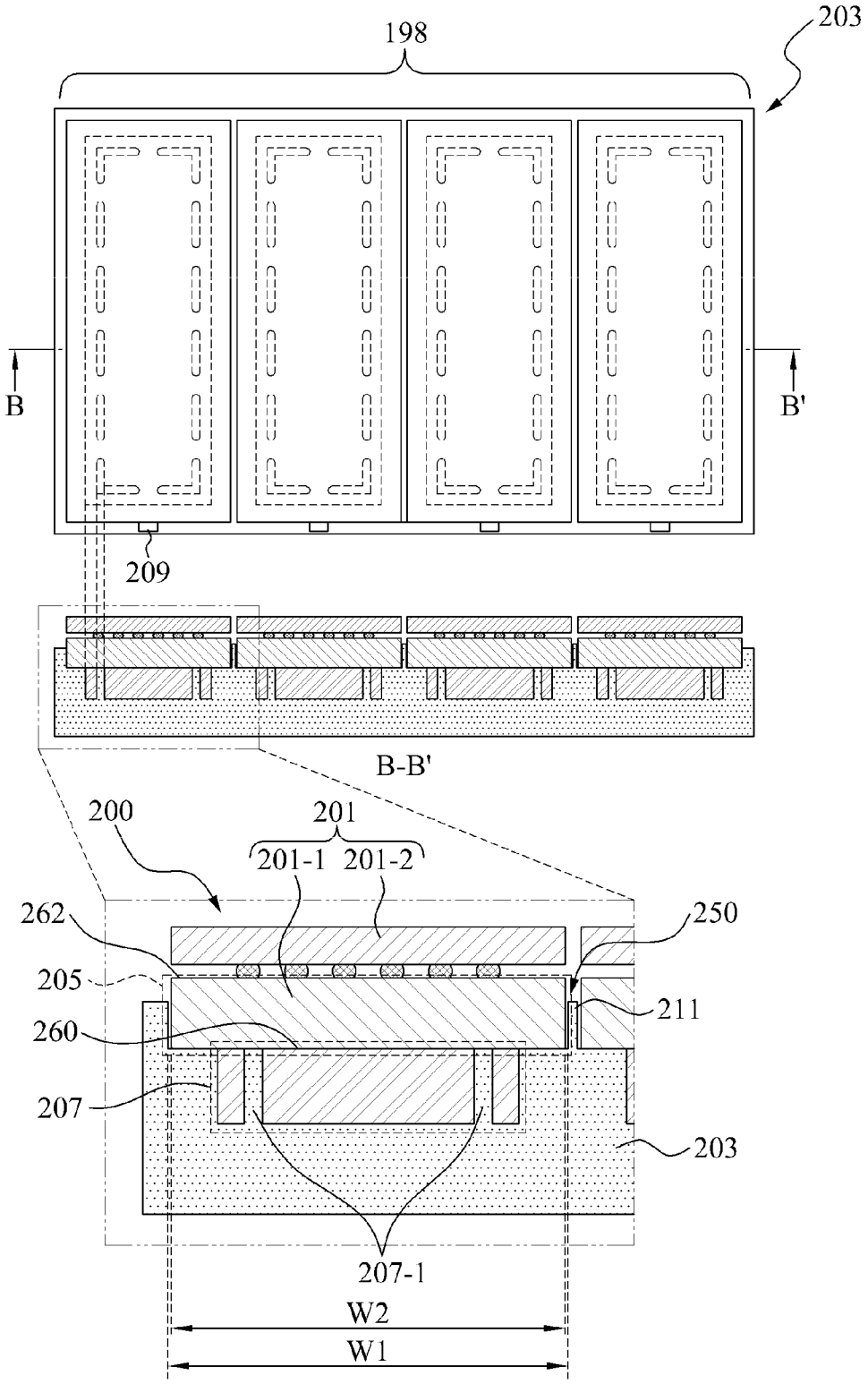
FIG. 2 illustrates an example of a multi-array ultrasonic probe apparatus according to an exemplary embodiment.

FIG. 2 illustrates an example of a multi-array ultrasonic probe apparatus 200. In particular, an uppermost diagram is a top view of the multi-array ultrasonic probe apparatus 200, and a lowermost diagram is a cross-sectional view cut along a line B-B'.

Referring to FIG. 2, the multi-array ultrasonic probe apparatus 200 includes a tile 201, and a substrate 203.

For instance, n tiles 198 may be provided. Here, n denotes a natural number. The tile 201 may transmit and receive an ultrasonic beam with respect to a target object. The tile 201 includes an ASIC 201-1, with a lower portion 260 disposed on a corresponding adhesive portion 207, and a CMUT 201-2 disposed on an upper portion 262 of the ASIC 201-1. For instance, the CMUT 201-2 may be attached to the ASIC 201-1 by flip chip bonding technology.

As an example, the substrate 203 may be formed of silicon, glass, or a polymer-based material. The substrate 203 includes guide portions 205 and adhesive portions 207, which correspond to n tiles 198. An outlet or outlets 209 may be disposed on one or both sides of one or more of the adhesive portions 205.

The substrate 203 may be formed by semiconductor process technology or imprinting technology. As an example, when the guide portion 205 and the adhesive portion 207 are formed on the substrate 203 by the semiconductor process technology, a margin of error of the guide portion 205 and the adhesive portion 207 may be reduced to be within a few micrometers (μm). Accordingly, the tiles 198 to be mounted in the respective guide portions 205 and to be in contact with adhesive portions 207 may be aligned uniformly. As another example, the substrate 203 is formed of the polymer-based material by the imprinting technology using a preformed substrate, for example a silicon substrate. Accordingly, the substrate 203 may be formed at a relatively low cost or in a relatively short period of time.

The n guide portions 205 corresponding to a number of the tiles 198 may be provided. The n tiles 198 may be mounted on the n guide portions 205, respectively, to be aligned in a form of a multi-array. The respective guide portion 205 may be provided in a shape identical to an outline of the tile 201 so that the tile 201 may be readily inserted and mounted on the guide portion 205. For example, the guide portion 205 may be formed to have inner corners provided at right angles, for example, in an L-shape and a mirrored L-shape. Accordingly, the tile 201 may be mounted in the guide portion 205 such that a portion of a lower end of the tile 201, and a portion of a side of the tile 201 may be in contact with the guide portion 205, simultaneously.

Also, by forming the guide portion 205 to have a width w1 wider than a width w2 of the tile 201 by a predetermined size, for example, 10 to 20 micrometers (μm), the tile 201 may be readily inserted in the guide portion 205. The tile 201 may be mounted in a central portion of the guide portion 205 such that a predetermined gap 250 may be maintained on both sides of the tile 201. For example, when the width w1 of the guide portion 205 is wider than the width w2 of the tile 201 by 10 μm, a 5 μm gap may be maintained on a left side between the guide portion 205 and one side of the tile 201, and a 5 μm gap may be maintained on a right side between the guide portion 205 and another side of the tile 201, as seen in a lower part of FIG. 2.

The adhesive portion 207 may be formed on or proximate to a lower portion of the respective guide portion 205, and an adhesive material, for example epoxy, may be disposed in the adhesive portion 207 to bond the tile 201 to the substrate 203.

The n guide portions 205 may be disposed in a form of a matrix on the substrate 203 such that a predetermined gap, for example, a 20 μm gap, separates the n guide portions from one another. The n adhesive portions 207 may be disposed in a form of a matrix on the substrate 203 such that a predetermined gap, for example, a 20 μm gap, separates the n adhesive portions 207 from one another. The n tiles 198 to be mounted in the guide portions 205, respectively, may be disposed collinearly, for example, in an x-axial direction or a y-axial direction, whereby the n tiles 198 may be aligned in uniform directions. That is, the directions of the n tiles 198 may be aligned by the n guide portions 205 and the n adhesive portions 207. Accordingly, a direction for transmitting and receiving an ultrasonic beam at the tiles 198 may be controlled, whereby an accuracy of the ultrasonic beam may be increased.

The guide portion 205 may be formed to have a width wider than a width of the corresponding adhesive portion 207 so that the tile 201 may be in contact with the adhesive portion 207 disposed in a lower portion of the guide portion 205, and a portion in which the tile 201 may be mounted stably may be secured.

The n guide portions 205 may each have identical heights h1, and the n adhesive portions 207 may each have identical heights h2. For example, the n guide portions 205 may each be formed to have identical heights in a range of tens of μm to hundreds of μm. Also, the n adhesive portions 207 each may be formed to have identical heights in a range of tens of μm to hundreds of μm.

When each of the n guide portions 205 is formed to have identical heights, and each of the n adhesive portions 207 is formed to have identical heights, the tiles 198 may be mounted on the substrate 203 at identical heights, whereby even leveling of the tiles 198 may be supported and provided. Accordingly, the n guide portions 205 and the n adhesive portions 207 may enable the leveling of the tiles 198 such that a time for transmitting and receiving the ultrasonic beam at the n tiles 198 may be controlled, for example, identically.

That is, the n guide portions 205 and the n adhesive portions 207 may enable the n tiles 198 to have identical heights. Accordingly, when each of the tiles 198 transmits an ultrasonic beam to a target object at identical times, and a feedback ultrasonic beam arrives from the target object at identical times, the feedback ultrasonic beam may be received or detected at identical times.

However, the heights of the guide portions 205 or the heights of the adhesive portions 207 may be identical or different.

At least one of the adhesive portions 207 may include a first projection 207-1, for example, a column-shaped projection, to reduce a movement of the adhesive portion 207 resulting from oscillation of the corresponding tile 201 occurring during transmission and reception of an ultrasonic beam, thereby bonding the tile 201 to the substrate 203 more stably. As shown in FIG. 2, two first projections 207-1 are formed, but this is not limiting and any appropriate number of projections may be formed.

Outlets 209 may be provided on one side or both sides of the n adhesive portions 207. When the adhesive material, disposed in the respective adhesive portion 207 is pressed by the tile 201 to be mounted in the guide portion 205, the adhesive material may be discharged to an outside. That is, when the tile 201 is inserted in the respective guide portion 205, the outlet 209 may provide a path for discharging the adhesive material disposed in the respective adhesive portion 207 to the outside of the structure, thereby preventing the adhesive material from leaking to the tile 201 to prevent a malfunction of the tile 201.

The substrate 203 further includes a second projection 211 which is disposed between the adjacent guide portions 205 and has sides proximate to adjacent guide portions 205, respectively, to separate the adjacent guide portions 205. The second projection 211 may be formed to have, for example, a height and a width in a range of tens of μm.

Figure 3:
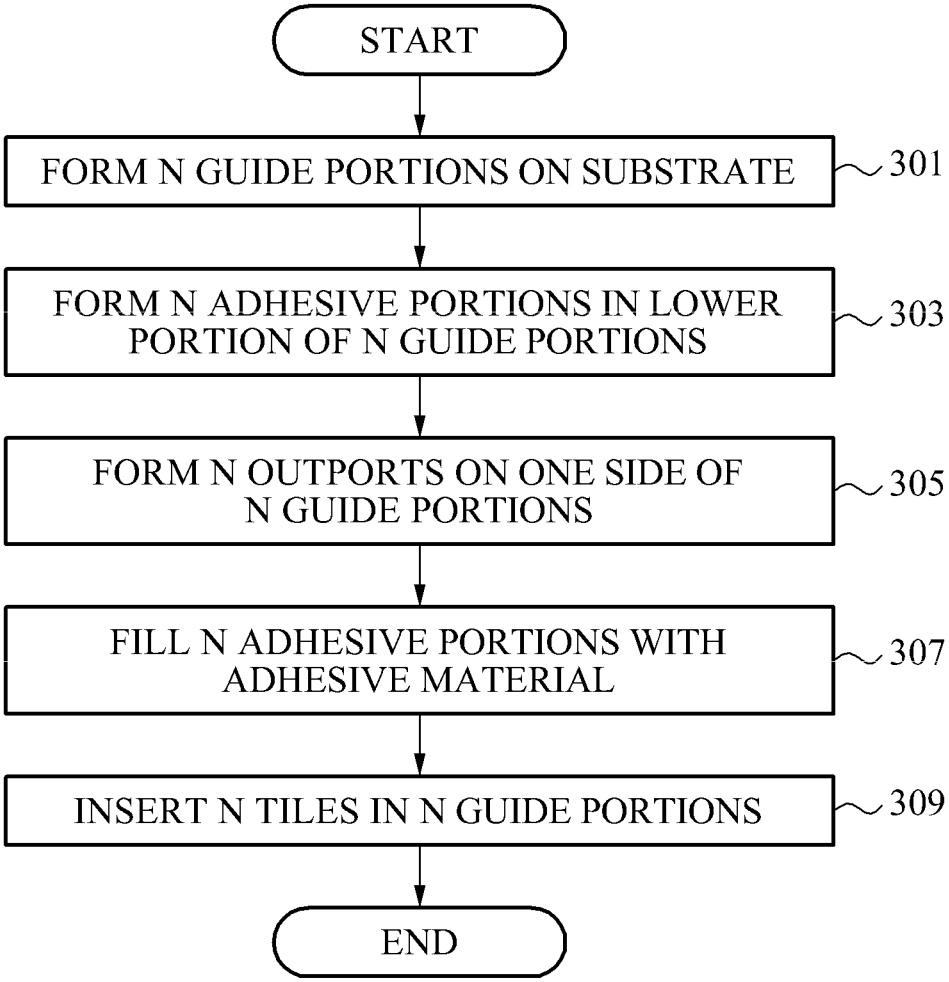
FIG. 3 is a flowchart illustrating an example of a method of manufacturing a multi-array ultrasonic probe apparatus according to an exemplary embodiment.

FIG. 3 illustrates an example of a method of manufacturing a multi-array ultrasonic probe apparatus.

Referring to FIG. 3, in operation 301, n guide portions are formed, on a substrate, to mount n tiles, respectively.

The substrate may include a polymer substrate, a Silicon-on-Insulator (SOI) substrate, a substrate formed of at least one semiconductor material including silicon (Si), germanium (Ge), silicon germanium (SiGe), gallium phosphide (GaP), gallium arsenide (GaAs), silicon carbide (SiC), silicon germanium carbide (SiGeC), indium arsenide (InAs), and indium phosphide (InP), and the like. However, the semiconductor material is not limited thereto.

The n guide portions may be disposed in a form of a matrix on the substrate such that a predetermined gap, for example, a 20 μm gap, separates the n guide portions. That is, the n guide portions may enable the n tiles to be disposed collinearly, for example, in an x-axial direction or a y-axial direction, so that the n tiles may be aligned in uniform directions. Accordingly, a direction for transmitting and receiving an ultrasonic beam at the tiles may be controlled, whereby an accuracy of the ultrasonic beam may be increased.

When the n guide portions are formed to have identical heights in the range of tens of μm to hundreds of μm, leveling of the n tiles to be mounted in the n guide portions may be supported.

A guide portion may be formed to have a width wider than a width of a tile by a predetermined size, for example, 10 μm to 20 μm, whereby the tile may be readily inserted.

Also, when the n guide portions are formed, a second projection, for example, a column-shaped projection, may be formed on the substrate to separate adjacent guide portions. That is, the second projection may correspond to a portion remaining between the adjacent guide portions, without being etched, during a process of forming the n guide portions, for example, by an etching process. For example, the second projection may be formed to have a height and a width of tens of μm.

In operation 303, n adhesive portions are formed in a lower portion of the guide portions. An adhesive material, for example epoxy, may be disposed in the n adhesive portions to bond the n tiles to the substrate.

The n adhesive portions may be disposed in a form of a matrix in the lower portion of the guide portions, at positions corresponding to positions of the n guide portions. For example, the n adhesive portions may be formed to have identical heights in the range of tens of μm to hundreds of μm.

An adhesive portion may be formed to have a width narrower than a width of a guide portion by a predetermined size such that a tile to be mounted in the guide portion may be in contact with the adhesive portion while a gap for mounting the tile stably may be secured in the guide portion.

Also, the adhesive portion may include a first projection, for example, a column-shaped projection, thereby reducing a movement of the adhesive portion resulting from oscillation generated by the tile to be mounted in the guide portion and to be in contact with the adhesive portion during transmission and reception of an ultrasonic beam. Accordingly, the tile may be bonded to the substrate more stably.

In operation 305, n outlets are formed, on one side of the n adhesive portions, to discharge the adhesive material to be disposed in the adhesive portion to an outside.

Figure 4:
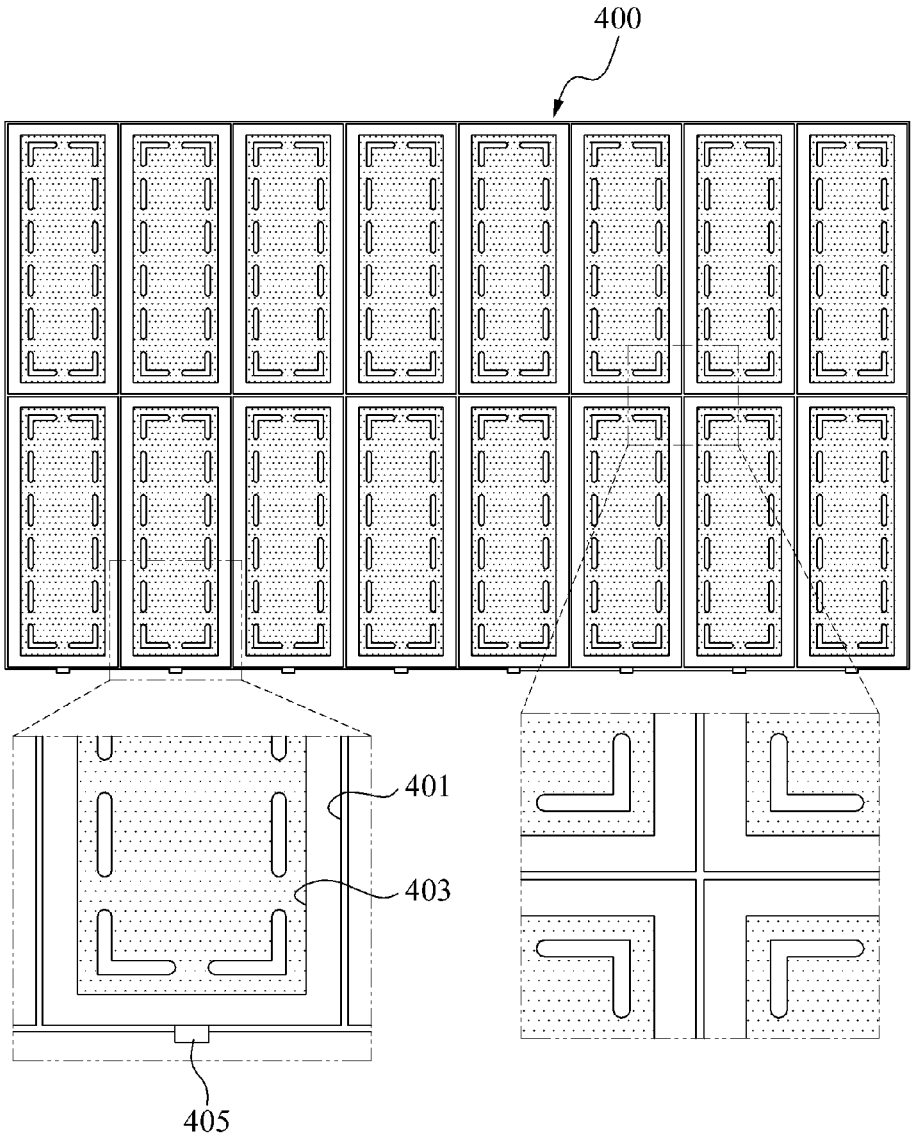
FIG. 4 is a top view illustrating an example of a substrate in a multi-array ultrasonic probe apparatus according to an exemplary embodiment.

For instance, the substrate may be formed, as shown in FIG. 4. Although the outlets are formed on one side of the adhesive portions, the positions of the outlets are not limited thereto. For example, the outlets may be formed on both sides facing each other, whereby the adhesive material may be discharged to the outside on both sides. Referring to FIG. 4, the substrate 400 includes n guide portions 401, n adhesive portions 403, and n outlets 405.

In operation 307, the n adhesive portions are filled with the adhesive material, for example, epoxy.

Figure 5:
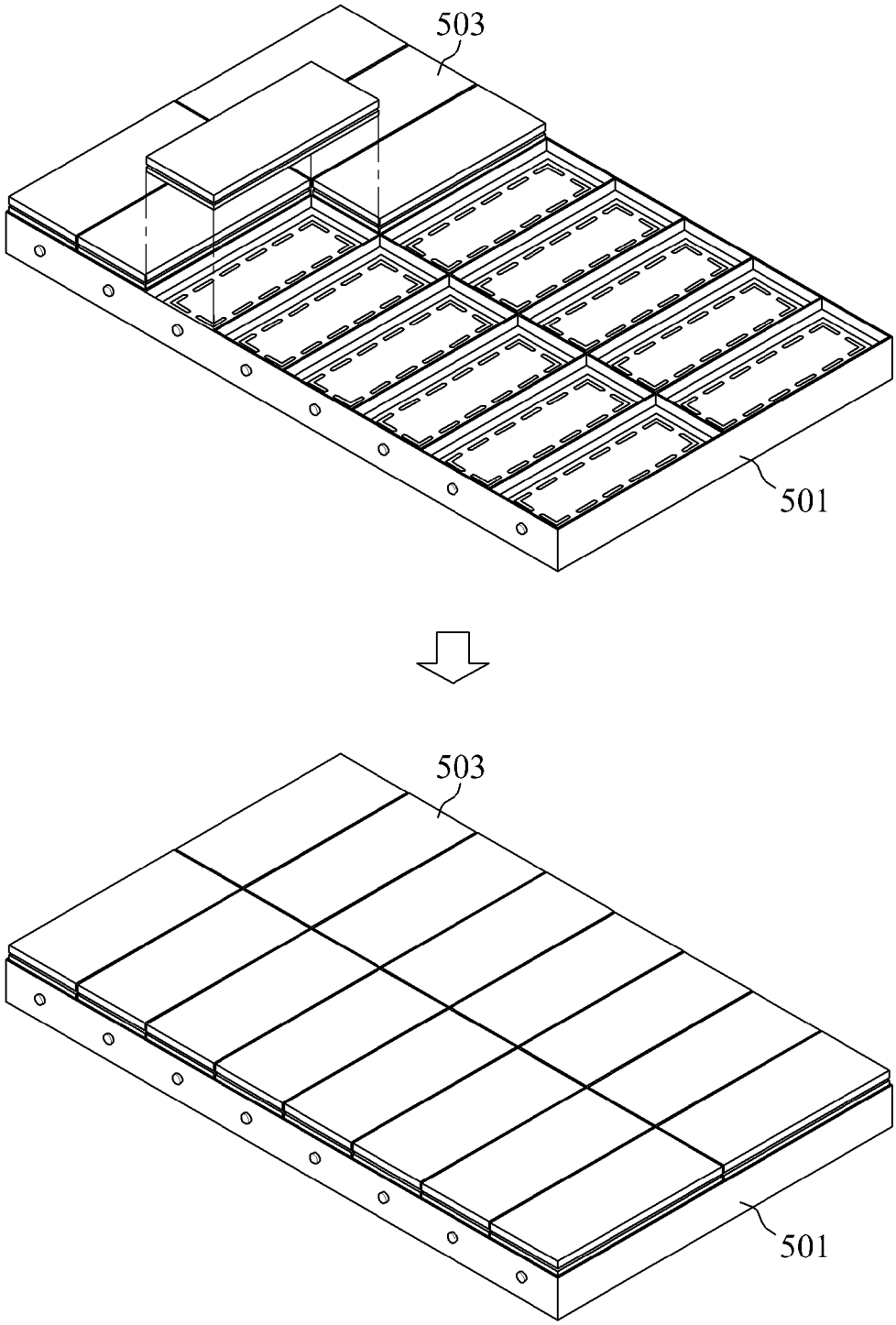
FIG. 5 is a perspective view illustrating an example of inserting tiles in a multi-array ultrasonic probe apparatus according to an exemplary embodiment.

In operation 309, the n tiles are inserted in the n guide portions, respectively. For instance, the n tiles may be mounted on the substrate, as shown in FIG. 5. An individual tile may correspond to a chip on which an ASIC and a CMUT may be laminated sequentially.

As shown in FIG. 5, a multi-array ultrasonic probe apparatus may be formed by mounting n tiles 503 on a substrate 501, sequentially.

For instance, the outlets formed on one side of the adhesive portions may discharge the adhesive material to an outside when the adhesive material is pressed by the tiles to be mounted in the guide portions and simultaneously, to be in contact with the adhesive material disposed in the adhesive portions disposed in a lower portion of the guide portions. That is, an outlet may provide a path for discharging the adhesive material to the outside when the tiles are mounted in the guide portion, thereby preventing the adhesive material from leaking to the tile, and preventing damage to the tile.

Figure 6:
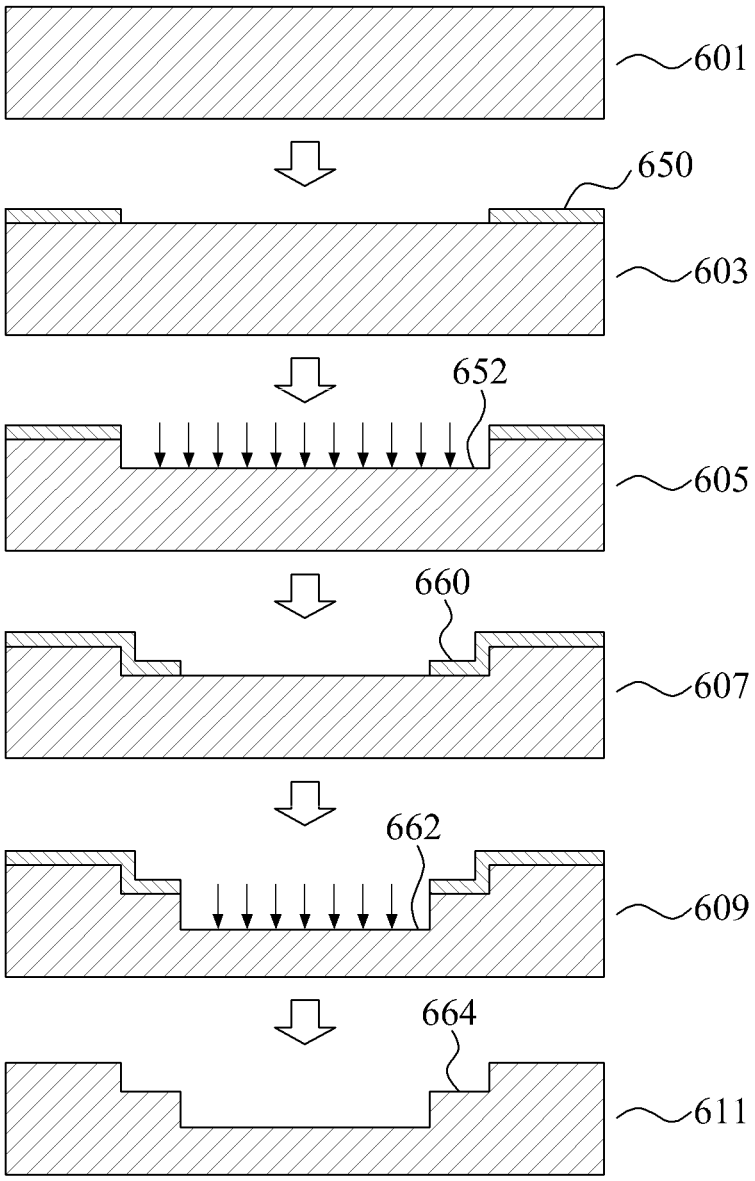
FIG. 6 is a cross-sectional view to describe an example of a method of manufacturing a substrate of a multi-array ultrasonic probe apparatus according to an exemplary embodiment.

FIG. 6 illustrates an example of a method of manufacturing a substrate of a multi-array ultrasonic probe apparatus.

Referring to FIG. 6, in operation 601, a substrate is provided. As an example, the substrate may be formed of silicon, or glass.

In operation 603, a first photo resist (PR) pattern 650 is formed on the substrate. The first PR pattern may define a first hole 652 in which a tile may be disposed.

In operation 605, the first hole, corresponding to a guide portion, is formed by etching the substrate using the first PR pattern as an etching mask. For instance, a height of the first hole may be controlled by etching the substrate to a depth in the range of tens of μm to hundreds of μm.

For instance, a plurality of first holes may be formed in rows and columns to be separated from each other by a predetermined gap. As an example, the plurality of first holes may be formed collinearly, in an x-axial direction or a y-axial direction. Accordingly, a plurality of tiles to be fixed in the plurality of holes may be aligned in uniform directions.

The first hole may be formed to have a width wider than a width of the tile by a predetermined size, for example, 10 μm to 20 μm, whereby the tile may be readily inserted.

Also, when the first hole is formed, a second projection, for example, in a column-shaped projection, may be formed, on the substrate, to separate adjacent first holes. That is, the second projection may refer to a portion remaining between the adjacent first holes, without being etched by the first PR pattern, during a process of forming the first holes on the substrate through an etching process.

In operation 607, a second PR pattern 660 is formed on the first hole. The second PR pattern may define a second hole 662 in which an adhesive material may be disposed.

In operation 609, the second hole, corresponding to an adhesive portion, is formed by etching a portion of the first hole using the second PR pattern as an etching mask. For instance, a height of the second hole may be controlled by etching the first hole to a depth in the range of tens of μm to hundreds of μm.

A plurality of second holes may be formed in a lower portion of the plurality of first holes forming a ledge 664 corresponding to a lower portion of the guide portion. The ledge may be formed to extend continually around the perimeter of the second hole 662 or may be formed to extend from the opposite sides of the first hole 652, forming two ledges. However, the configuration of the ledge is not limited thereto. Similarly to the plurality of first holes, the plurality of second holes may also be formed in rows and columns to be separated from each other by a predetermined gap.

In operation 611, the first PR pattern and the second PR pattern are eliminated. The elimination of the first PR pattern and the second PR pattern may be performed using a method generally known in the art, for example, an ashing process using gas plasma, for example, oxygen gas ($O_2$), nitrogen gas ($N_2$), hydrogen gas ($H_2$), and the like.

Using the semiconductor process technology as described in operations 601 through 611, the first hole, that is, the guide portion, and the second hole, that is, the adhesive portion, may be formed on the substrate, by controlling a size of the first hole and a size of the second hole adroitly in units of μm. The size of the first hole and the size of the second hole may include, for example, a height, and a width. The plurality of first holes and the plurality of second holes may be provided in a form of a matrix including rows and columns, whereby the substrate on which tiles may be aligned in a form of a multi-array may be formed.

Figure 7:
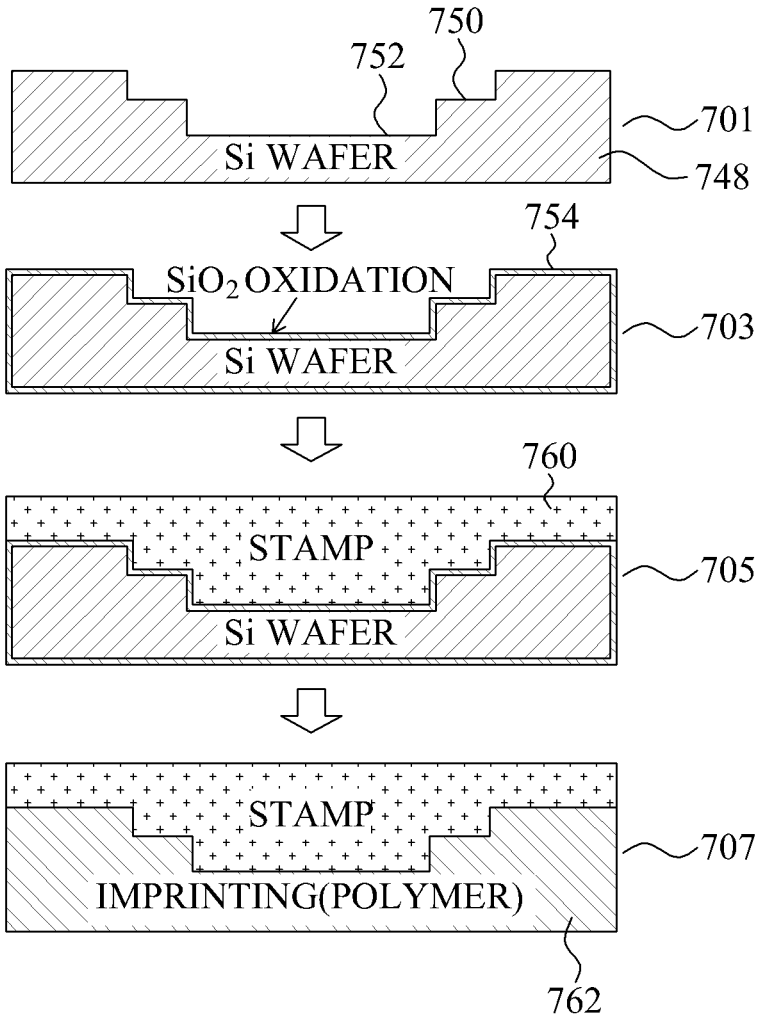
FIG. 7 is a cross-sectional view to describe another example of a method of manufacturing a substrate of a multi-array ultrasonic probe apparatus according to an exemplary embodiment.

FIG. 7 illustrates another example of a method of manufacturing a substrate of a multi-array ultrasonic probe apparatus.

Referring to FIG. 7, in operation 701, a first substrate 748 including a guide portion 750 and an adhesive portion 752 is provided. The first substrate may refer to a substrate formed by the operations of FIG. 6. As an example, the substrate may be formed of silicon, or glass.

In operation 703, an oxidized layer 754 is formed by oxidation of a surface of the first substrate 748. Operation 703 may be omitted selectively.

In operation 705, a stamp frame 760 is formed by forming an electroplating layer on the first substrate.

In operation 707, a second substrate 762 having an identical shape of the first substrate is formed, by performing imprinting on the second substrate that is formed of a polymer-based material, using the stamp frame as an imprinting jig.

For instance, the substrate may be formed at a relatively low cost or in a relatively short period of time by forming the substrate using imprinting technology, when compared to a substrate formed using the semiconductor process technology.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A multi-array ultrasonic probe apparatus, comprising:

n tiles which transmit and receive ultrasonic beams; and a substrate comprising:

n guide portions on which the n tiles are mounted, respectively, to be aligned in a multi-array, each of the n guide portions comprising:

first sides extending from a surface of the substrate substantially perpendicularly to the surface of the substrate, and opposing ledges which extend from the first sides substantially perpendicularly to the first sides; and n adhesive portions which are disposed underneath the n guide portions and formed as cavities between the opposing ledges within respective guide portions, each of the n adhesive portions comprising:

second sides extending downward from the opposing ledges of a respective guide portion, and a bottom surface which extends from one of the second sides to another one of the second sides;

wherein an adhesive material is placed into a respective adhesive portion to attach each respective tile to the substrate, and opposing side portions of each respective tile are disposed on the opposing ledges of the respective guide portion and a center portion of each respective tile is disposed over the cavity of each respective adhesive portion.

2. The apparatus of claim 1, wherein the substrate further comprises:

n outlets which discharge, to an outside of the substrate, an excess of the adhesive material when the n tiles are being mounted on the n guide portions.

3. The apparatus of claim 1, wherein widths of the n guide portions are wider than widths of corresponding n adhesive portions.

4. The apparatus of claim 1, wherein each of the n guide portions has identical heights, and each of the n adhesive portions has identical heights.

5. The apparatus of claim 1, wherein:

the n guide portions are disposed in a matrix on the substrate with a first predetermined gap between adjacent guide portions to separate the adjacent guide portions from one another, and the n adhesive portions are disposed in a matrix on the substrate with a second predetermined gap between adjacent adhesive portions to separate the adjacent adhesive portions from one another.

6. The apparatus of claim 1, wherein widths of the n guide portions are wider than widths of the n tiles by a predetermined size.

7. The apparatus of claim 1, wherein each of the n tiles comprises:

an Application Specific Integrated Circuit (ASIC), a lower portion of which is disposed proximate the respective adhesive portion, and a Capacitive Micromachined Ultrasonic Transducer (CMUT) attached to an upper portion of the ASIC.

8. The apparatus of claim 1, wherein the substrate comprises one of silicon, glass, and a polymer-based material.

9. A method of manufacturing a multi-array ultrasonic probe apparatus comprising n tiles which transmit and receive ultrasonic beams; and a substrate comprising n guide portions on which the n tiles are mounted, respectively, to be aligned in a multi-array, each of the n guide portions comprising first sides extending from a surface of the substrate substantially perpendicularly to the surface of the substrate, and opposing ledges which extend from the first sides substantially perpendicularly to the first sides; and n adhesive portions which are disposed underneath the n guide portions and formed as cavities between the opposing ledges within respective guide portions, each of the n adhesive portions comprising second sides extending downward from the opposing ledges of a respective guide portion, and a bottom surface which extends from one of the second sides to another one of the second sides; wherein an adhesive material is placed into a respective adhesive portion to attach each respective tile to the substrate, and opposing side portions of each respective tile are disposed on the opposing ledges of the respective guide portion and a center portion of each respective tile is disposed over the cavity of each respective adhesive portion, the method comprising:

providing the substrate comprising the n guide portions and the n adhesive portions proximate to a lower portion of the n guide portions; and aligning the n tiles, which transmit and receive ultrasonic beams, in the multi-array by mounting the n tiles on the n guide portions, respectively.

10. The method of claim 9, wherein the providing further comprises:

providing the substrate with n outlets which discharge, to an outside of the substrate, an excess of the adhesive material when the n tiles are being mounted on the n guide portions.

11. The method of claim 9, wherein the n guide portions have widths wider than widths of corresponding n adhesive portions.

12. The method of claim 9, wherein each of the n guide portions has identical heights, and each of the n adhesive portions has identical heights.

13. The method of claim 9, wherein the n guide portions are disposed in a matrix with a first predetermined gap between adjacent guide portions to separate the adjacent guide portions from one another, and the n adhesive portions are disposed in a matrix with a second gap between adjacent guide portions to separate the adjacent adhesive portions from one another.

14. The method of claim 9, wherein the n guide portions have widths wider than widths of the n tiles by a predetermined size.

15. The method of claim 9, wherein each of the n tiles comprises an Application Specific Integrated Circuit (ASIC), and a Capacitive Micromachined Ultrasonic Transducer (CMUT) attached to an upper portion of the ASIC, and the aligning comprises mounting a lower portion of the ASIC onto respective guide portions.

16. The method of claim 9, wherein the substrate comprises one of silicon, glass, and a polymer-based material.

17. A device comprising:

a substrate;

n tiles aligned on the substrate in a multi-array, to transmit and receive ultrasonic beams; and n mounting portions which are disposed on the substrate separated from one another, each of the n mounting portions comprising a guide portion which aligns each respective tile on the substrate, the guide portion comprising:

first sides extending from a surface of the substrate substantially perpendicularly with respect to the surface of the substrate, and opposing ledges which extend from the first sides at a first height from the surface of the substrate, substantially perpendicularly with respect to the first sides; and adhesive portions which are disposed underneath respective guide portions and formed as cavities between the opposing ledges within the respective guide portions, each of the adhesive portions comprising:

second sides extending downward from the opposing ledges of a respective guide portion, and a bottom surface which extends from one of the second sides to another one of the second sides;

wherein an adhesive material is placed into a respective adhesive portion to attach each respective tile to the substrate, and opposing side portions of each respective tile are disposed on the opposing ledges of the respective guide portion and a center portion of each respective tile is disposed over the cavity of each respective adhesive portion.

18. The device of claim 17, wherein the bottom surface of each adhesive portion is disposed at a second height greater than the first height, from the surface of the substrate, and attaches each respective tile to the substrate.

19. The device of claim 18, wherein the substrate further comprises:

outlets each of which extends from a respective cavity to an outside of the substrate and discharges an excess of the adhesive material which builds up in the respective adhesive portion when the tiles are being mounted onto respective mounting portions.

* * * * *